US008985881B2

(12) United States Patent
Hefetz et al.

(10) Patent No.: US 8,985,881 B2
(45) Date of Patent: Mar. 24, 2015

(54) LIPSTICK TUBE

(75) Inventors: Safi Hefetz, Tel Aviv (IL); Raz Moheban, Tel Aviv (IL)

(73) Assignee: IL Makiage Cosmetics (2013) Ltd, Tel Aviv (IL)

( * ) Notice: Subject to any disclaimer, the term of this patent is extended or adjusted under 35 U.S.C. 154(b) by 773 days.

(21) Appl. No.: 13/177,681

(22) Filed: Jul. 7, 2011

(65) Prior Publication Data

US 2013/0011175 A1 Jan. 10, 2013

(51) Int. Cl.

| | |
|---|---|
| ***B43K 21/02*** | (2006.01) |
| ***A45D 40/04*** | (2006.01) |
| *A45D 40/20* | (2006.01) |
| *A45D 40/12* | (2006.01) |

(52) U.S. Cl.

CPC ..... *A45D 40/04* (2013.01); *A45D 2040/208* (2013.01); *A45D 40/12* (2013.01)

USPC ..... 401/98

(58) Field of Classification Search

CPC ..... A45D 40/02; A45D 40/04; A45D 40/06; A45D 40/12; A45D 240/208

USPC ..... 401/59, 62, 86, 102, 79, 77, 78

See application file for complete search history.

(56) References Cited

U.S. PATENT DOCUMENTS

| | | | | |
|---|---|---|---|---|
| 2,088,899 | A * | 8/1937 | Chevreau | 401/62 |
| 2,273,138 | A * | 2/1942 | Peterson | 401/86 |
| 2,395,535 | A | 2/1946 | Crane | |
| 5,902,062 | A * | 5/1999 | Rosenblatt et al. | 401/86 |
| 6,033,140 | A | 3/2000 | Peng Huang | |

FOREIGN PATENT DOCUMENTS

| | | |
|---|---|---|
| EP | 0876777 A1 | 11/1998 |
| FR | 798416 A | 5/1936 |

* cited by examiner

*Primary Examiner* — David Walczak
*Assistant Examiner* — Bradley Oliver
(74) *Attorney, Agent, or Firm* — Deborah Gador

(57) ABSTRACT

A lipstick tube including a hollow cylindrical base, a lipstick holder disposed in the base, a cap longer than the distance between the top of the protruding element and the top of a lipstick in the lipstick holder covering the lipstick holder, and a protruding element affixed to the lipstick holder and moving together with the lipstick holder relative to the base, the protruding element protruding radially from the holder for engaging the cap in a closed orientation.

9 Claims, 5 Drawing Sheets

LIPSTICK TUBE

FIELD OF THE INVENTION

The present invention relates to containers for lipstick and, in particular, to lipstick tubes.

BACKGROUND OF THE INVENTION

At present, lipstick tubes are cylindrical devices including a rotating or pushup base which raises the lipstick out of the base for application to the lips. After application, turning the base of the tube in the opposite direction typically pulls the lipstick back inside. A cap is designed to cover the lipstick and cover and engage a portion of the base, to protect the open end of the lipstick from damage. However, the user must remember to manually retract the lipstick into the base before replacing the cap. Otherwise, the cap will press onto the lipstick, either ruining its rounded shape or mashing the lipstick into and over the base.

Accordingly, there is a long felt need for a lipstick holder which prevents the lipstick from being distorted when the cover is replaced.

SUMMARY OF THE INVENTION

The present invention relates to a lipstick tube which is designed to prevent the cap from pressing on the lipstick. The lipstick tube includes a base and a lipstick holding portion with a protruding element, which may be, for example, in the form of a ring around the base or a pair of support pins extending radially from the sides. The diameter of the protruding portion is larger than that of the cap, so that the cap seats on the protruding element when covering the lipstick. Thus, the protruding element prevents the cap from touching the lipstick, even if the lipstick was not retracted into the base. The protruding element can be rotated by the user to retract the lipstick holding portion and the lipstick into the base.

There is thus provided, according to the present invention, a lipstick tube including a hollow cylindrical base, a lipstick holder disposed in the base, a cap longer than the distance between the top of the protruding element and the top of a lipstick in the lipstick holder covering the lipstick holder, and a protruding element affixed to the lipstick holder and moving together with the lipstick holder relative to the base, where the protruding element protrudes radially from the holder for engaging the cap in a closed orientation.

According to a preferred embodiment, the base includes a pair of spiral grooves extending longitudinally along its side wall, and the protruding element includes a pair of pins extending radially from the lipstick holder, the pins being slidingly seated in the grooves.

Further according to a preferred embodiment, the protruding element further includes an annular ring extending around the tube and engaging the pins.

There is also provided a method for protecting lipstick in a lipstick tube, the method including providing a hollow cylindrical base, disposing a lipstick holder in the base, and affixing a protruding element to the lipstick holder, the protruding element protruding radially from the base for engaging a cap in a closed orientation.

Preferably, the method further includes covering the lipstick and the lipstick holder with a cap longer than a lipstick mounted in the lipstick holder until the cap engages the protruding element.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a lipstick tube designed to prevent the cap from pressing on the lipstick when the user covers the tube without retracting the lipstick into the base. This is accomplished by providing a protruding element affixed to the lipstick holding portion of the tube which engages or serves as a stop member for the cap and prevents it from squeezing the lipstick into the lipstick holding portion. Since the diameter of the protruding element is slightly larger than that of the cap, the cap abuts the protruding element when covering the lipstick. Thus, the protruding element prevents the cap from touching the lipstick, even if the lipstick was not retracted into the base before replacing the cap. The protruding element can be rotated by the user to retract the lipstick holding portion and the lipstick into the base.

Figure 1C:
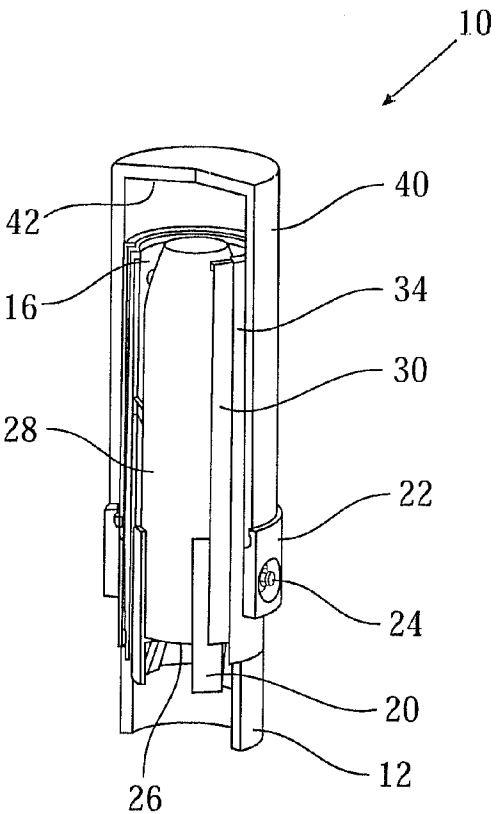
FIG. 1*c* is a cut away view of the lipstick tube of FIG. 1*a* with lipstick therein.
Figure 1B:
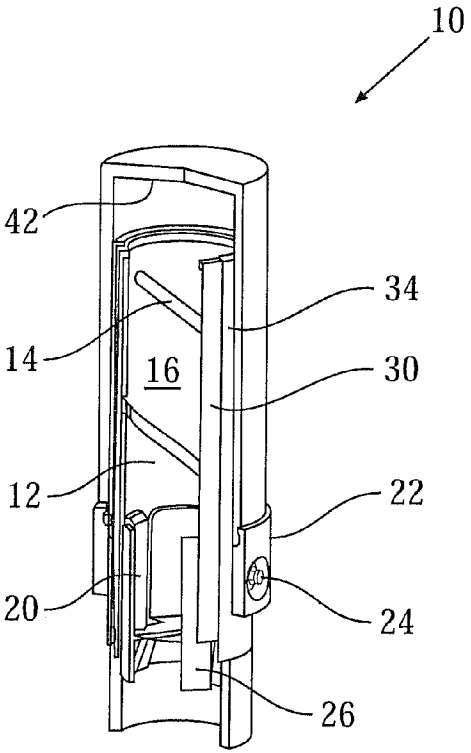
FIG. 1*b* is a cut away view of the lipstick tube of FIG. 1*a;*
Figure 1A:
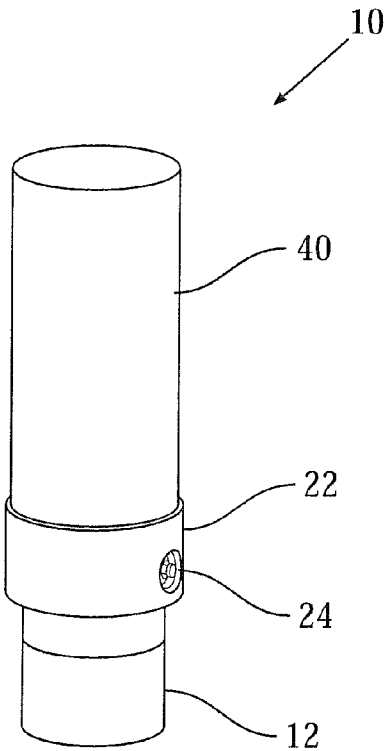
FIG. 1*a* is a plan view illustration of a lipstick tube constructed and operative in accordance with one embodiment of the present invention.

Referring now to FIGS. 1*a*, 1*b* and 1*c*, there are shown a plan view and cut away views, respectively, of a lipstick tube 10 constructed and operative in accordance with one embodiment of the present invention. Lipstick tube 10 includes a hollow, cylindrical base 12, here illustrated as defining a pair of spiral grooves 14 and 14' (shown in FIG. 2*b*) along its side wall 16, as known. A lipstick holder 20, in which the lipstick 28 is disposed, seats in the base and is arranged to rotate as it rises along the side wall 16 of the base. A protruding element 22, here illustrated as a ring, is coupled to lipstick holder 20, as by a pair of pins 24, and extends radially beyond the base. Lipstick tube 10 further includes a cap 40 having a closure surface 42 for closing the tube and covering the top of the lipstick and a bottom edge 44. Cap 40 is arranged to engage protruding element 22. It will be appreciated that the length of cap 40, from closure surface 42 to bottom edge 44, is longer than the distance from the top of the protruding element to the top of a lipstick in the lipstick holder. In this way, the closure surface 42 is always distanced from the tip of a lipstick seated in the holder, as can be seen in FIG. 1*c*.

Figure 2A:
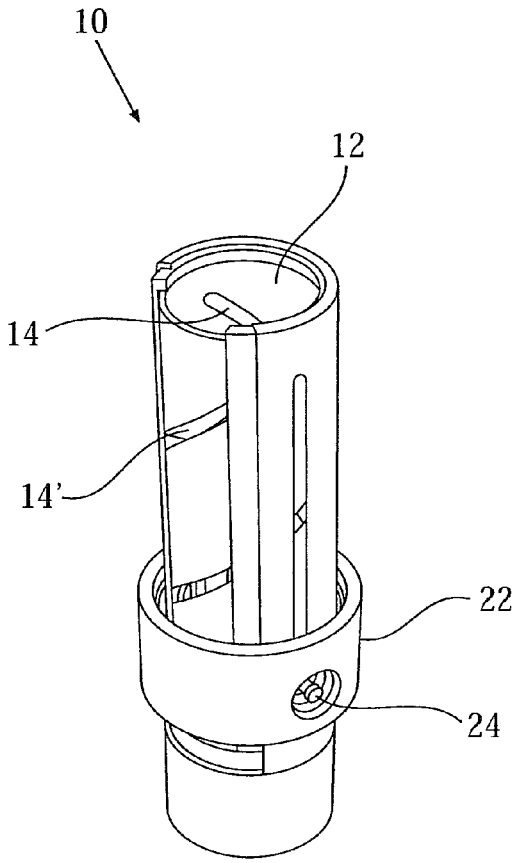
FIG. 2*a* is a plan view illustration of the lipstick tube of FIG. 1*a* without the cap.
Figure 2B:
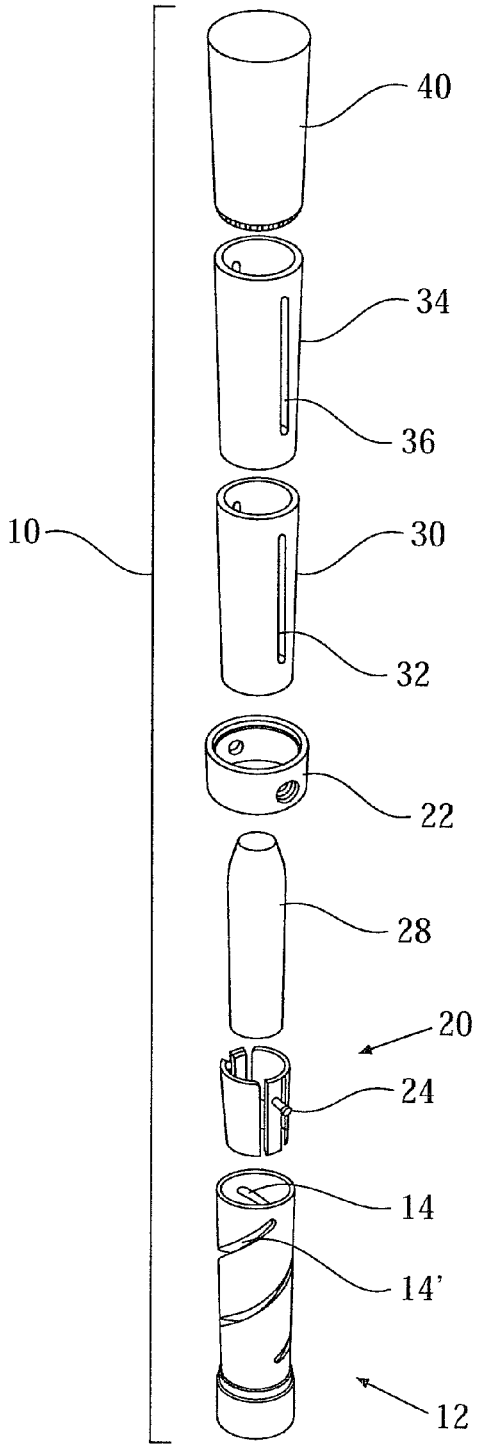
FIG. 2*b* is an exploded view of the lipstick tube of FIG. 1*a;*

The structure and operation of a preferred embodiment of the invention can be better understood from FIG. 2*a* and FIG. 2*b*, a view without the cap and an exploded view, respectively, of the lipstick tube of FIG. 1*a*. As can be seen, lipstick tube 10 includes base 12 with spiral grooves 14 and 14' extending along its side wall 16.

Lipstick tube 10 may further include a first sleeve 30, typically of plastic, defining longitudinal grooves 32 and 32' along a substantial portion of its length and substantially opposite each other, through which pins 24 pass. Sleeve 30 is provided to surround the lipstick 28 and prevent the ring and attached lipstick from rotating, as known. An optional outer sleeve 34, having a diameter which is larger than the diameter of sleeve 30, also defining longitudinal grooves 36 and 36' along a substantial portion of its length and substantially opposite each other for passage of pins 24, may be provided for aesthetic reasons, to cover and hide the mechanism from view, as known. It will be appreciated that corresponding sleeves, without a longitudinal groove, are known and in use in conventional lipstick tubes and do not form part of the novel mechanism of the present invention.

Lipstick holder 20 includes at least two pins 24 arranged to engage the grooves in the base and sleeves. Lipstick holder 20 further includes a protruding element 22 extending radially beyond the base. In this embodiment, the protruding element 22 includes a ring mounted about sleeve 34 on pins 24. A hollow cap 40 is provided to cover the sleeves, lipstick and side wall 16 of the base. Cap 40 is sized to enclose the lipstick and sleeves 30 and 34, when present, and to seat on protruding element 22, as seen in FIG. 1*a*.

Figures 3A, 3B, 3C, 3D, 4A, 4B, 4C:
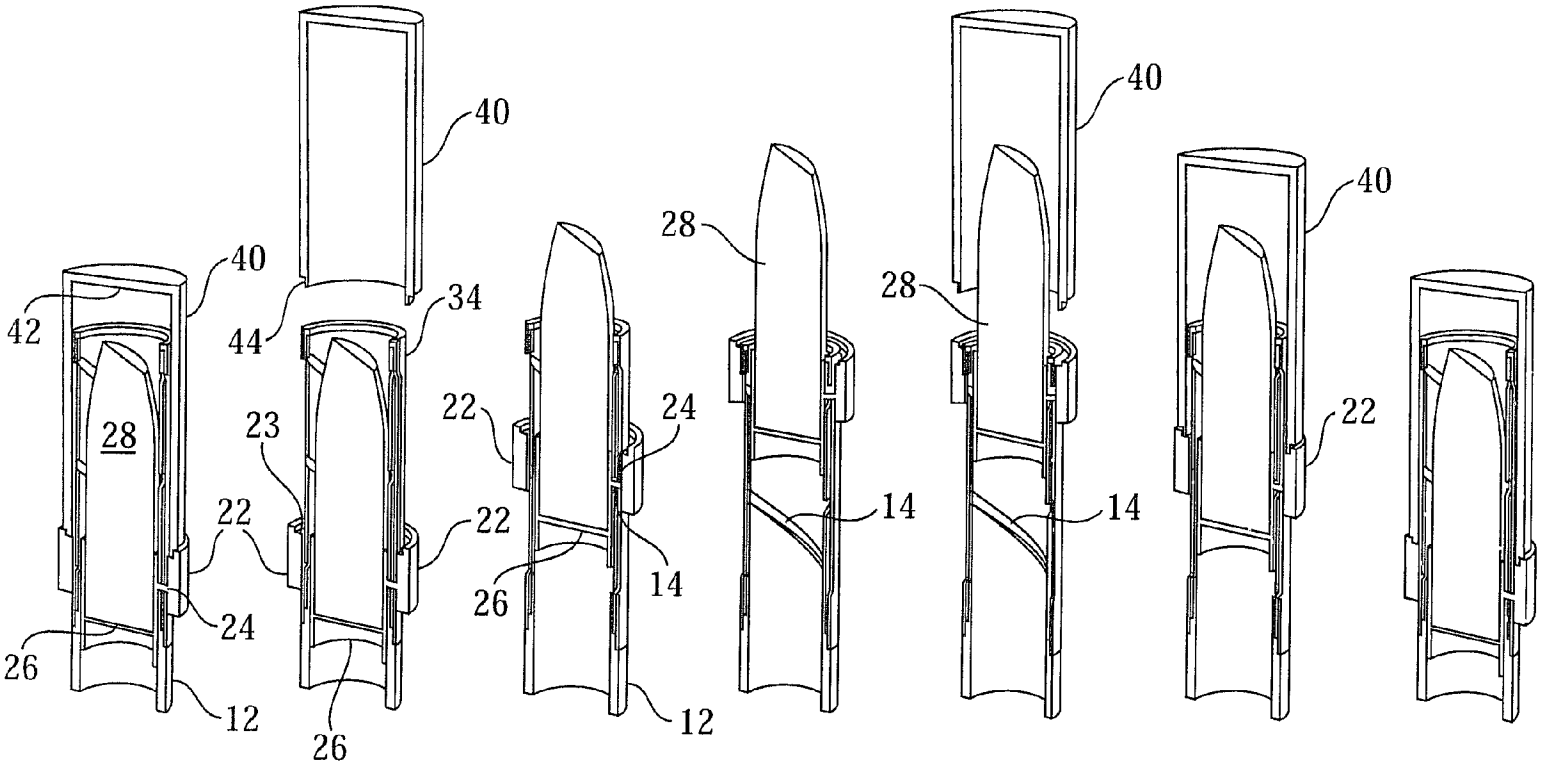
FIGS. 3*a* to 3*d* are schematic illustrations of the process of cap removal and lipstick extraction, according to one embodiment of the invention.
FIGS. 4*a* to 4*c* are schematic illustrations of the process of lipstick insertion and cap replacement, according to one embodiment of the invention.

FIGS. 3*a* to 3*d* are schematic illustrations of the process of cap removal and lipstick extraction, utilizing the lipstick tube 10 of FIG. 1*a*. In FIG. 3*a*, the lipstick 28 is shown seated on lipstick holder 20 and fully retracted inside base 12. Cap 40 is sized to abut and engage protruding element 22 in such a fashion that closure surface 42 is distanced from the tip of the lipstick 28 at all times.

Cap 40 is removed, as shown in FIG. 3*b*. According to some embodiments, the bottom edge 44 of cap 40 is flat and seats directly on ring 22. In other embodiments, such as illustrated in FIG. 3*b*, the bottom edge 44 includes an external undercut or step, and engages a complementary groove 23 in ring 22 for frictional engagement ensuring a tighter fit.

Now the user begins to rotate the ring 22 relative to the base 12, so as to cause the lipstick 28 to rise through the base 12 and protrude above the tube, as seen in FIG. 3*c*. As can be seen, pins 24 extend through groove 14 and engage ring 22, so that rotation of ring 22 relative to base 12 causes pins 24 to slide along grooves 14 and 14' in a spiral motion along the length of the base and raise lipstick holder 26 through the base. FIG. 3*d* shows the lipstick tube of the invention when the lipstick is fully extended.

FIGS. 4*a* to 4*c* are schematic illustrations of the process of lipstick insertion and cap replacement, according to one embodiment of the invention. Typically, the user will retract the lipstick into the tube before covering with the cap. However, in case this is not done, as shown in FIG. 4*a*, the cap 40 is replaced over the extended lipstick 28 until it seats on ring 22. Either the ring or the base is now rotated relative to the other, and the lipstick retracts together with the lipstick holder and the cap, downwards along the base (FIG. 4*b*) until fully retracted (FIG. 4*c*). It will be appreciated that alternative mechanisms for raising and lowering the lipstick can be employed within the scope of the present invention.

Figure 5:
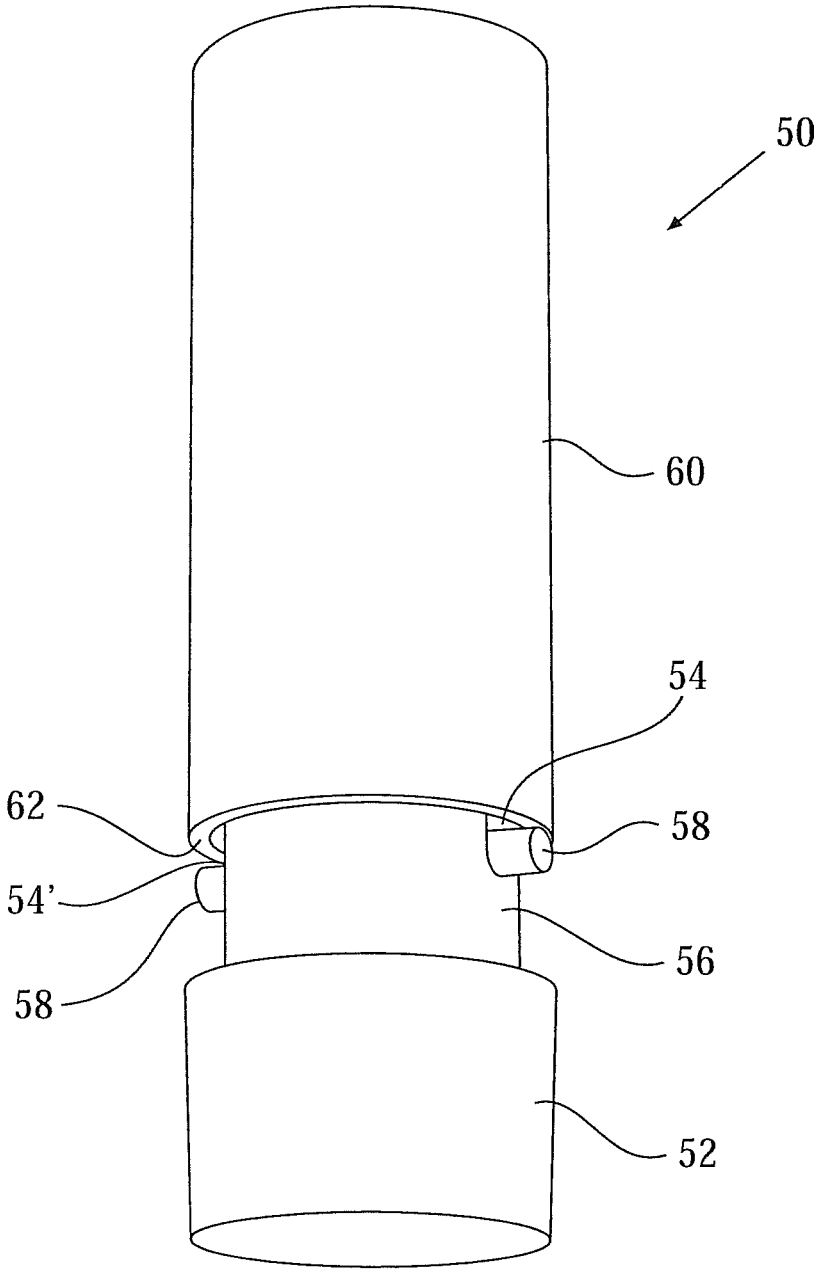
FIG. 5 is a perspective view of a lipstick tube constructed and operative in accordance with a further embodiment of the present invention.

Referring now to FIG. 5, there is shown a perspective view of a lipstick tube 50 constructed and operative in accordance with an alternative embodiment of the present invention. Lipstick tube 50 includes a base 52 defining spiral grooves 54 and 54' longitudinally along its side wall 56, as described above, and a cap 60, here illustrated as having a planar lower edge 62. A lipstick holder (not shown) is provided inside base 52. In this embodiment, the protruding element 58 is a pair of pins extending from the lipstick holder through grooves 54 and 54'. As can be seen, bottom edge 62 of cap 60, in the closed orientation, engages pins 58 so as not to press on the lipstick inside. Alternatively, any other design of protruding element coupled to the lipstick holder may be provided.

Figure 6C:
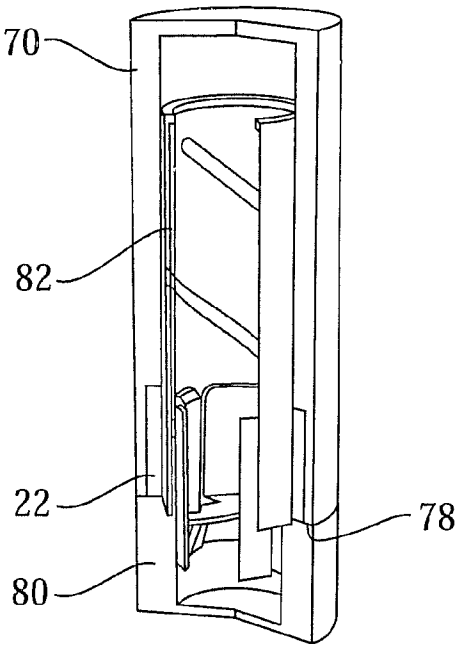
FIG. 6*c* is a cut away view of the lipstick tube of FIG. 6*a*.
Figure 6B:
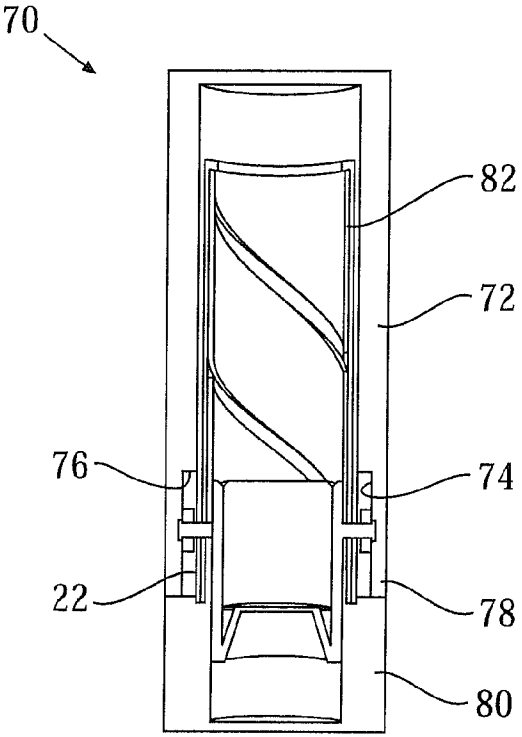
FIG. 6*b* is a sectional view of the lipstick tube of FIG. 6*a*.
Figure 6A:
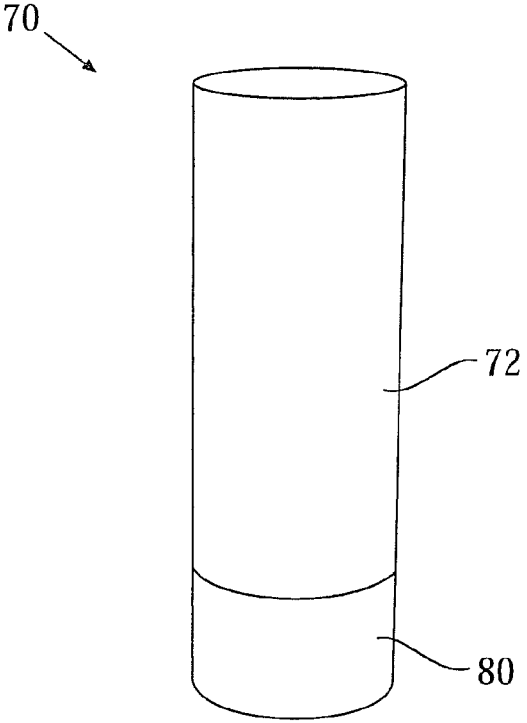
FIG. 6*a* is a plan view illustration of a lipstick tube constructed and operative in accordance with another embodiment of the present invention.

FIGS. 6*a*, 6*b* and 6*c* are plan, sectional and cut-away views, respectively, of a lipstick tube 70 constructed and operative in accordance with another embodiment of the present invention. Lipstick tube 70 is substantially similar to lipstick tube 10 so the mechanism will not be described again. Lipstick tube 70 differs in the cap 72 and the base 80. Base 80 has a larger diameter than the protruding element 22 and, in the fully retracted position shown in FIG. 6*b*, the protruding element seats on the base.

Cap 72 is designed to cover and enclose the protruding element, for a more streamlined appearance. Thus, cap 72 includes an internal undercut 74 defining a shoulder 76 and an elongated bottom edge 78. Shoulder 76 is designed to seat on and engage the protruding element, here ring 22, while the elongated edge 78 of the cap covers the protruding element and possibly the side wall 82 of the base, until it engages the base 80.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A lipstick tube comprising:

a hollow cylindrical base including first and second spiral grooves extending longitudinally in parallel around the side wall of the base;

a lipstick holder disposed in the base;

a protruding element including first and second pins extending radially from said lipstick holder opposite and in registration with one another, said first pin extending through said first spiral groove and said second pin extending through said second spiral groove for sliding along the grooves;

a first sleeve surrounding the base side wall and defining longitudinal grooves along a substantial portion of its length and substantially opposite each other, through which said pair of pins pass; and a second sleeve surrounding the first sleeve and covering the first sleeve from view, and defining longitudinal grooves along a substantial portion of its length and substantially opposite each other in registration with the grooves in said first sleeve, through which said pair of pins pass;

a cap covering the lipstick holder and engaging said protruding element in a closed orientation.

2. The lipstick tube according to claim 1, wherein said protruding element further includes a ring coupled to the pair of pins and disposed around the tube; said cap engaging said ring in a closed orientation.

3. The lipstick tube according to claim 1, wherein said cap has a flat bottom edge.

4. The lipstick tube according to claim 1, wherein said cap has an undercut bottom edge.

5. The lipstick tube according to claim 4, wherein, in a closed orientation, said undercut bottom edge is elongated, covers said protruding element and engages said base.

6. The lipstick tube according to claim 1, wherein said base has a larger diameter than the protruding element such that, in the fully retracted position, the protruding element seats on the base.

7. The lipstick tube according to claim 1, wherein said cap is longer than the distance between a top of the protruding element and a top of a lipstick in the lipstick holder.

8. A method for protecting lipstick in a lipstick tube, the method comprising:

providing a hollow cylindrical base including first and second spiral grooves extending longitudinally in parallel around the side wall of the base;

affixing a protruding element including first and second pins to the lipstick holder, the first and second pins extending radially from said lipstick holder opposite and in registration with one another, said first pin extending through said first spiral groove and said second pin extending through said second spiral groove for sliding along the grooves, disposing the lipstick holder in the base, said protruding element protruding radially from said base for engaging a cap in a closed orientation;

surrounding said base side wall with a first sleeve, the first sleeve defining longitudinal grooves along a substantial portion of its length and substantially opposite each other, and causing said pair of pins to pass through said longitudinal grooves; and surrounding the first sleeve with a second sleeve and covering the first sleeve from view, said second sleeve defining longitudinal grooves along a substantial portion of its length and substantially opposite each other in registration with the grooves in said first sleeve, and causing said pair of pins to pass through the longitudinal grooves in said second sleeve.

9. The method according to claim 8, further comprising covering the lipstick and the lipstick holder with the cap until the cap engages the protruding element.

* * * * *